US007946958B2

(12) United States Patent
Wu

(10) Patent No.: US 7,946,958 B2
(45) Date of Patent: May 24, 2011

(54) EXERCISE MACHINE CAPABLE OF PROVIDING SUITABLE TRAINING AND CONTROL METHOD THEREOF

(76) Inventor: Mu-Chuan Wu, Tainan Hsien (TW)

( * ) Notice: Subject to any disclaimer, the term of this patent is extended or adjusted under 35 U.S.C. 154(b) by 6 days.

(21) Appl. No.: 12/010,337

(22) Filed: Jan. 24, 2008

(65) Prior Publication Data

US 2009/0192021 A1 Jul. 30, 2009

(51) Int. Cl.
*A63B 24/00* (2006.01)

(52) U.S. Cl. ..... 482/4

(58) Field of Classification Search ..... 482/1, 4, 482/8

See application file for complete search history.

(56) References Cited

U.S. PATENT DOCUMENTS 6,050,924 A * 4/2000 Shea ..... 482/57
6,805,656 B2 * 10/2004 Ogawa ..... 482/8
2007/0219051 A1 * 9/2007 Hayashino et al. ..... 482/1
2007/0219059 A1 * 9/2007 Schwartz et al. ..... 482/8
2008/0171639 A1 * 7/2008 Hahn ..... 482/52

* cited by examiner

*Primary Examiner* — Loan Thanh
*Assistant Examiner* — Shila Abyaneh
(74) *Attorney, Agent, or Firm* — Posz Law Group, PLC

(57) ABSTRACT

An exercise machine and control method thereof, the control method comprising following steps: setting personal physical parameters, receiving a mode selection command, determining to enter either an automatic operating mode or a manual operating mode, entering the automatic operating mode, receiving a program selection command and reading a corresponding training program, generating an automatic operating command by comparing the personal physical parameters with the training program and outputting the automatic operating command to the exercise machine and activating the exercise machine according to the automatic operating command. The exercise machine thus can adjust its training strength based on the input personal physical parameters. Therefore users of the exercise machine with different physical conditions will individually have the better sports effect.

11 Claims, 7 Drawing Sheets

EXERCISE MACHINE CAPABLE OF PROVIDING SUITABLE TRAINING AND CONTROL METHOD THEREOF

BACKGROUND OF THE INVENTION

1. Field of the Invention

The present invention relates to an exercise machine and control method thereof, especially relates to an exercise machine that can accommodate a user's physical condition to provide a suitable training.

2. Description of the Related Art

A conventional exercise machine can provide different exercising or training modes that are preset by the producer. The conventional exercise machine includes a motive power generating apparatus and a control circuit. The control circuit controls the motive power generating apparatus to be operated in different mechanical motion modes. For example, a treadmill has a belt driven by a motor assembly. The motor assembly is controlled by a control circuit to increase or decrease it's revolutions, so as to change the slipping speed of the belt. Thus when running on the belt, the user must adjust his/her running speeds to accommodate the belt. The user then can experience different extents of sports effect.

However, even thought the exercise machine is operated in the same training mode, users may have different sports effects due to their differences of personal physical conditions.

The conventional exercise machine may further have a manual mode that allows the user to create a customized training program, which is more flexible than the preset modes. However, without the expert's assistance and teaching, users may incorrectly estimate their own physical conditions, create an inappropriate training program and be unable to have the best sports effect.

SUMMARY OF THE INVENTION

One objective of the present invention is to provide an exercise machine and control method thereof that can provide a suitable range of training strength for users according to their physical conditions.

A control method of an exercise machine in accordance with the present invention comprises:

setting personal physical parameters in the exercise machine;

receiving a mode selection command;

determining whether the exercise machine being operated in either an automatic operating mode or a manual operating mode;

entering the preset program operating mode;

receiving a program selection command and selecting one of multiple training programs being stored in the exercise machine;

generating a automatic operating command based on the personal physical parameters and the selected training program; and outputting the automatic operating command to activate the exercise machine based on the automatic operating command.

With foregoing steps the exercise machine can adjust its training strength base on the entered personal physical parameters.

The exercise machine comprises a memory unit, a command input unit, a control unit, a motive power generating unit and a power supply unit. The memory unit has multiple training programs individually providing a series of exercising postures. The command input unit is for setting personal physical parameters, a customized exercise parameters as desired and entering a mode selection command and a program selection command. The control unit connects to the command input unit and the memory unit and receives the personal physical parameters, the customized exercise parameters, the mode selection command or the program selection command form the command input unit and gives a manual operating command or an automatic operating command to activate the exercise machine by comparing the personal physical parameters with the customized exercise parameters or with the program selection command. The motive power generating unit connects to the control unit through a connecting interface, receives the operating command of the control unit and is driven according to the received commands. The power supply unit connects to the control unit and provides electric power to the control unit.

The memory unit further includes multiple posture display images respectively representing the exercising postures and being shown by the exercise machine visually.

The exercise machine further comprises a display unit connecting to the control unit displaying one of the posture display images of the memory unit to demonstrate how the exercising posture is practiced.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
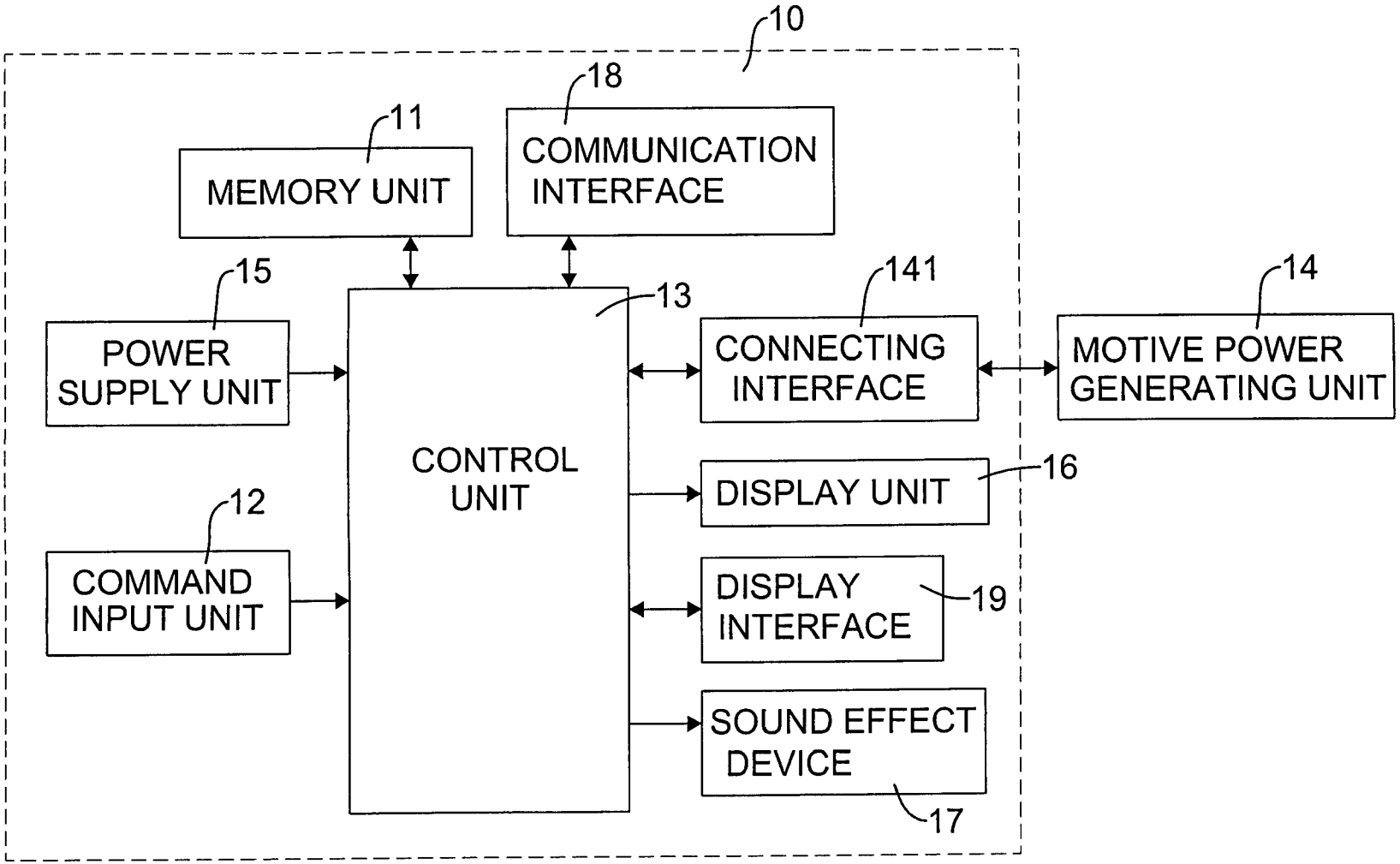
FIG. 1 is a block diagram of an exercise machine in accordance with the present invention.

With reference to FIG. 1, an exercise machine (10) in accordance with the present invention comprises a memory unit (11), a command input unit (12), a control unit (13), a motive power generating unit (14), a power supply unit (15), an optional display unit (16), an optional sound effect device (17), an optional communication interface (18) and an optional display interface (19).

The memory unit (11) stores with multiple training programs and multiple posture display images. Each training program is preset and provides a series of exercising postures and includes multiple parameter sets. Each exercising posture corresponds to one parameter set. Each parameter set can comprise a time parameter, a frequency parameter and a posture parameter. The time parameter defines an operating time of the exercise machine (10). The frequency parameter defines an operating frequency of the exercise machine (10). The posture display images respectively correspond to the posture parameters and may be dynamic images or static images demonstrating the exercising postures individually and are shown by the exercise machine (10) visually.

The command input unit (12) is for a user to set personal physical parameters and customized exercise parameters and to receive a mode selection command and a program selection command. The personal physical parameters may include a weight parameter, a height parameter, an age parameter and a gender parameter. The customized exercise parameters may include an amplitude parameter, a time parameter, a frequency parameter and a posture parameter. The amplitude parameter, the time parameter and the frequency parameter respectively represent an operating amplitude, an operating time and an operating frequency of the exercise machine (10). Each posture parameter corresponds to a posture display image stored in the memory unit (11). According to the customized exercise parameters, the exercise machine (10) will be operated for the operating time with the operating amplitude and the operating frequency, and will show the designated posture display image.

The control unit (13) connects to the command input unit (12) and the memory unit (11), and receives the personal physical parameters, the customized exercise parameters, the mode selection command or the program selection command from the command input unit (12). Base on the mode selection command, the control unit (13) generate a manual operating command or an automatic operating command to activate the exercise machine (10) based on the personal physical parameters, the customized exercise parameters, and the program selection command.

The motive power generating unit (14) connects to the control unit (13) through a connecting interface (141), receives the operating commands of the control unit (13) and is activated according to the received operating commands.

The power supply unit (15) connects to the control unit (13) and provides electric power to the control unit (10).

The display unit (16) connects to the control unit (13), displays the posture display image to demonstrate how the exercising posture is practiced.

The sound effect device (17) connects to the control unit (13) and generates a sound when the training program is started or finished.

The communication interface (18) connects to the control unit (13) and may be implemented as a wired RS-232 to USB connecting interface, an infrared module, a RF module or a bluetooth data transfer module. An external electronic device may link to the exercise machine (10) via the communication interface (18).

The display interface (19) connects to the control unit (13) for connecting to an external monitor to showing the posture display images more clearly.

Figure 2:
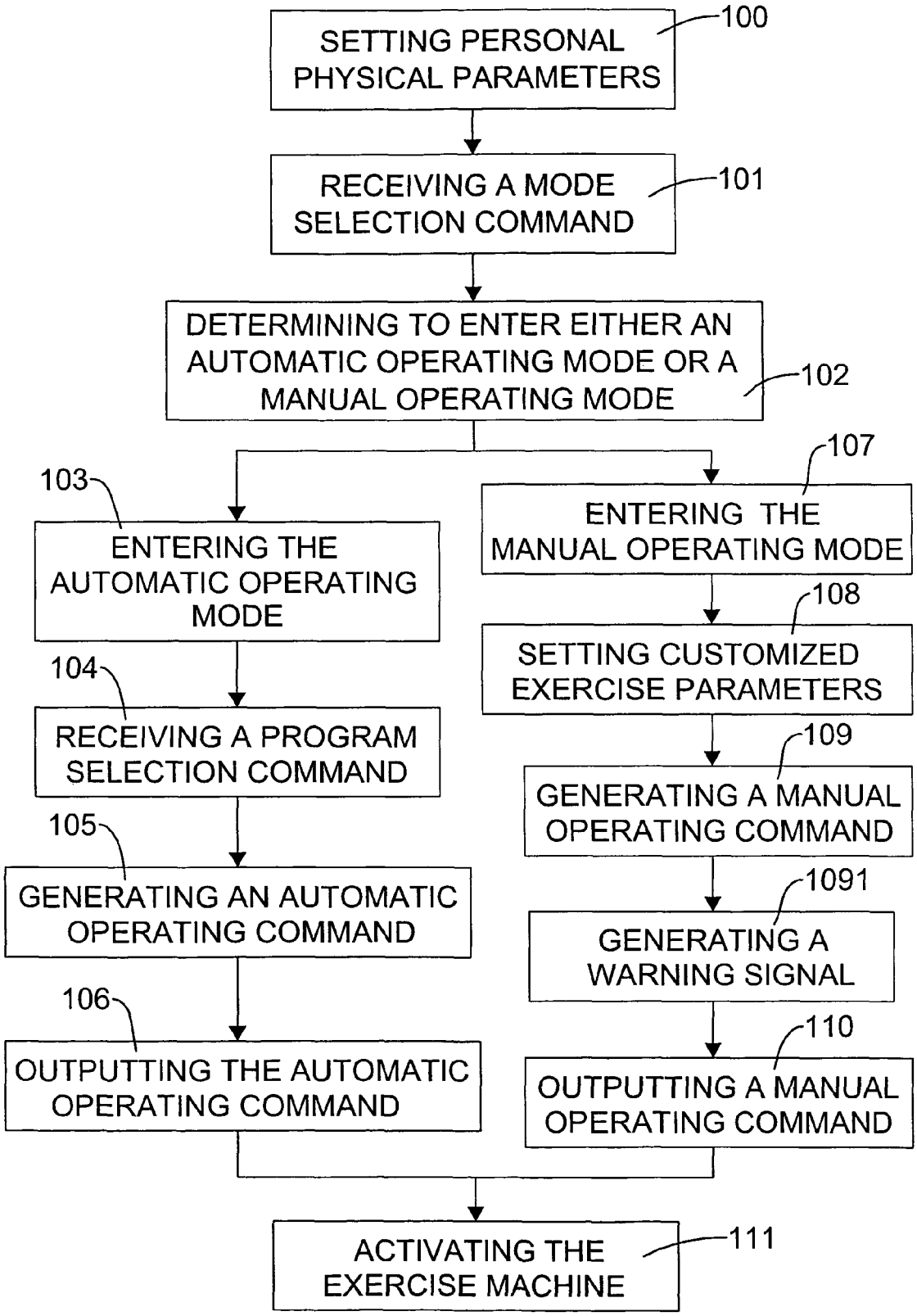
FIG. 2 is a flowchart of the control method of the exercise machine in accordance with the present invention.

With reference to FIG. 2, the control method of the exercise machine comprises following steps of setting personal physical parameters (100), receiving a mode selection command (101), determining to enter either an automatic operating mode or a manual operating mode (102), entering the automatic operating mode (103), receiving a program selection command (104), generating an automatic operating command (105), outputting the automatic operating command (106) and activating the exercise machine (10) (111).

In the step of setting personal physical parameters (100), one user sets his/her own personal physical parameters. The personal physical parameters include a weight parameter, a height parameter, an age parameter and a gender parameter.

In the step of receiving a mode selection command (101), a mode selection command is input by the user to the control unit (13) via the command input unit (12).

In the step of determining to enter either an automatic operating mode or a manual operating mode (102), the control unit (13) determines whether the exercise machine should be operated in the automatic operating mode or the manual operating mode according to the mode selection command.

In the step of receiving a program selection command (104), the user uses the command input unit (12) to enter a program selection command to the control unit (13), the control unit (13) thus reads a training program corresponding to the received program selection command.

In the step of generating an automatic operating command (105), the control unit (13) compares the personal physical parameters with the training program and accordingly generates the automatic operating command.

In the step of outputting the automatic operating command (106), the control unit (13) outputs the automatic operating command to activate the exercise machine (10).

With foregoing steps, the exercise machine can be activated.

Furthermore, in the step of determining to enter either the automatic operating mode or the manual operating mode (102), if the exercise machine is determined by the control unit (13) to be operated in the manual operating mode, following steps will be executed: entering the manual operating mode (107), setting customized exercise parameters (108), generating a manual operating command (109), outputting the manual operating command (110) and activating the exercise machine (10).

In the step of setting customized exercise parameters (108), the user enters customized exercise parameters to the control unit (13) via the command input unit (12).

In the step of generating a manual operating command (109), the control unit (13) generates the manual operating command according to the customized exercise parameters.

In the step of outputting the manual operating command (110), the control unit (13) outputs the manual operating command and activate the exercise machine (10) according to the manual operating command.

Figure 3:
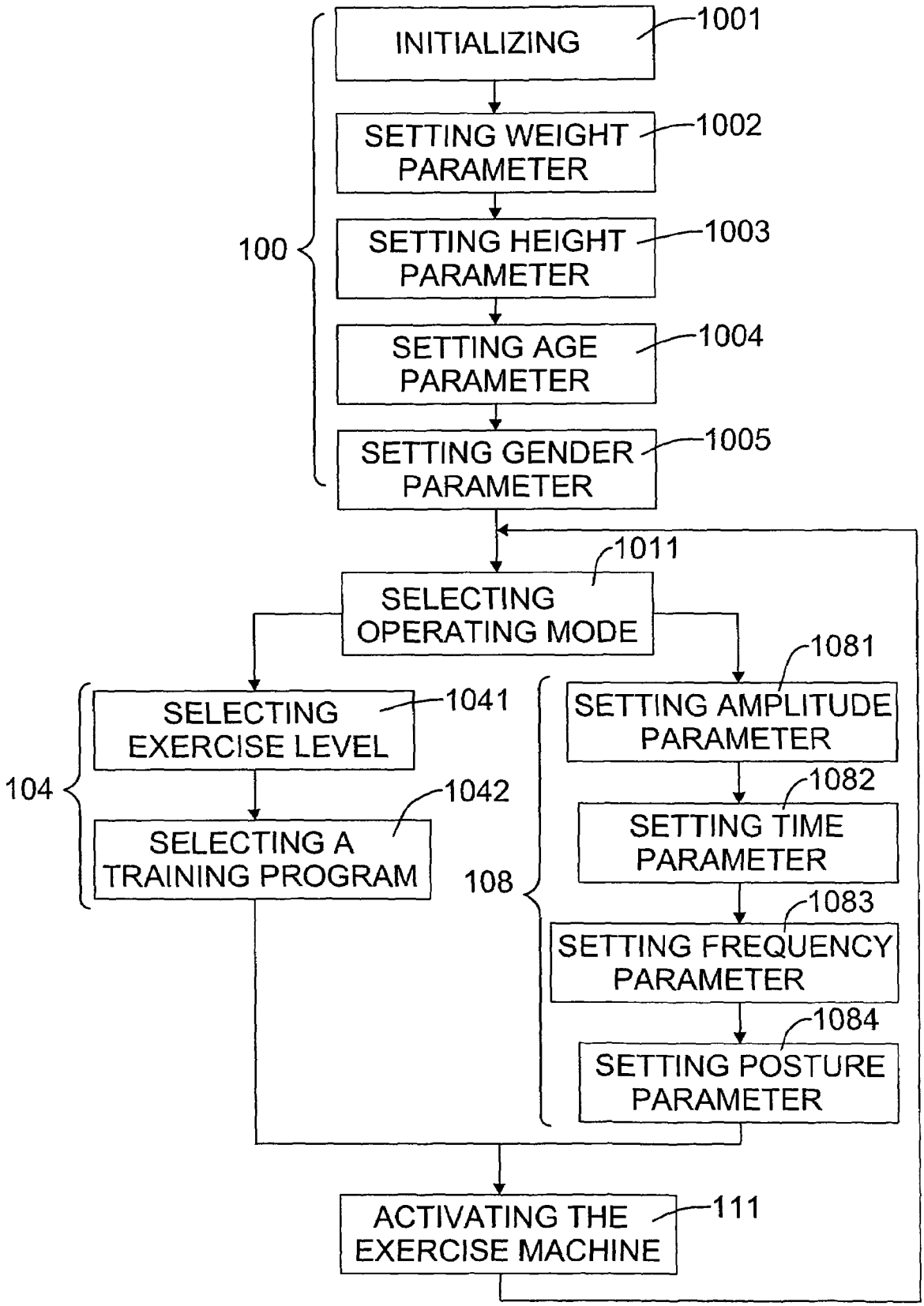
FIG. 3 is another flowchart of the control method of the exercise machine in accordance with the present invention.

With further reference to FIG. 3, because in this embodiment the personal physical parameters include a weight parameter, a height parameter, an age parameter and a gender parameter, thus the step of setting the personal physical parameters (100) may further include following steps: initializing (1001), setting weight parameter (1002), setting height parameter (1003), setting age parameter (1004) and setting gender parameter (1005).

The step of receiving a program selection command (104) may further include following steps: selecting exercise level (1041) and selecting a training program (1042).

The steps of receiving a mode selection command (101), determining to enter either an automatic operating mode or a manual operating mode (102), entering the automatic operating mode (103) and entering the manual operating mode (107) are organized into one step: selecting operating mode (1011).

In the step of selecting exercise level (1041), the user uses the command input unit (12) to select and enter a specific preset amplitude parameter (which may be named as beginner level, medium level or advanced level) to the control unit (13).

In the step of select a training program (1042), the user uses the command input unit (12) to enter the program selection command to the control unit (13) in order to select a preset training program.

In this embodiment, the foregoing customized exercise parameters include an amplitude parameter, a time parameter, a frequency parameter and a posture parameter and are executed to activate the exercise machine (10). The exercise machine (10) can be operated with a certain amplitude and a certain frequency during a certain time and show the posture display image. Consequently, the step of setting customized exercise parameters (108) may further includes following steps: setting amplitude parameter (1081), setting time parameter (1082), setting frequency parameter (1083) and setting posture parameter (1084).

Because any person can set customized exercise parameters, a warning signal is needed to avoid inappropriate customized exercise parameters from being easily executed by the exercise machine (10), as the inappropriate customized exercise parameters may result in an uncomfortable exercise. Therefore, after the step of generating the manual operating command (109), following step may be further executed: generating a warning signal (1091). In this step, the control unit (13) determines whether the user will feel uncomfortable while the exercise machine is operated based on the manual operating command. In other words, the control unit (13) determines whether the customized exercise parameters are within a specific permissible range. The permissible range is defined by the control unit (13) according to the personal physical parameters entered by the user. And if out of the range, the control unit (13) thus generates a warning signal before the exercise machine starts to be operated.

Figure 4:
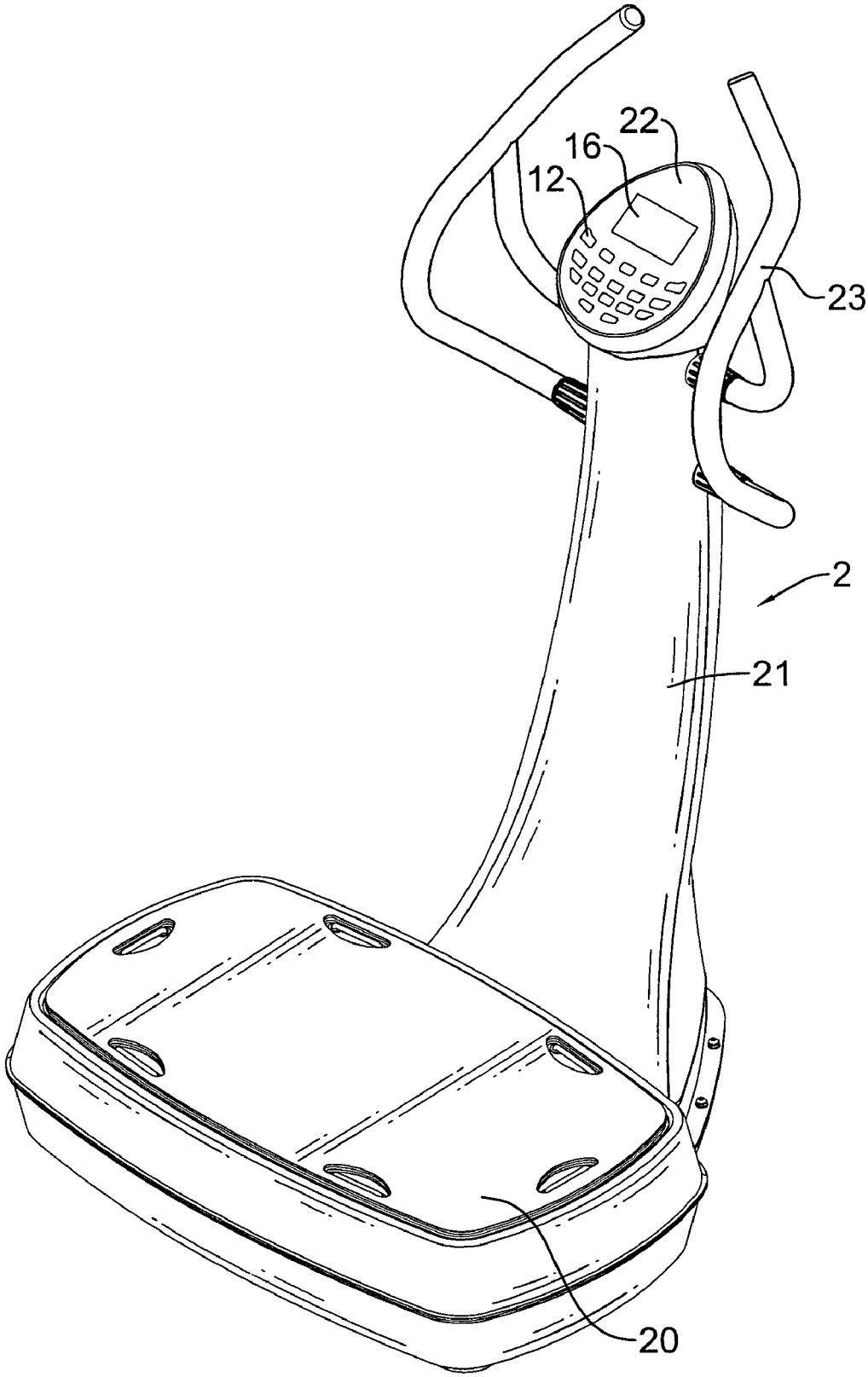
FIG. 4 is perspective view of a preferred embodiment of an exercise machine in accordance with the present invention.

With further reference to FIG. 4, the exercise machine is implemented as a vibration trainer (2). The vibration trainer (2) structurally comprises a platform (20), a neck (21), a control panel (22) and a handle set (23).

The platform (20) has a top surface and an edge. The foregoing motive power generating unit (14) is mounted inside the platform (20) and is implemented as a motor set which brings vibrations to the top surface.

The neck (21) upwardly extends from the edge of the platform (20) and has a top and two sides.

The control panel (22) is mounted upon the top of the neck (21). The foregoing command input unit (12) and display unit (16) are both mounted on the control panel (22). In this embodiment, the command input unit (12) is implemented as multiple buttons and the display unit (16) is a liquid crystal display module (LCM).

The handle set has two handles mounted and respectively extends from the sides of the neck (21).

When using this vibration trainer, the user first presses the buttons of the control panel (22) to enter his/her personal information such as height, weight, age and gender. Then the user continues to select either the automatic operating mode or the manual operating mode. Under the automatic operating mode, the user further selects the exercise level (which relates to the value of amplitude of the vibration trainer (2) in this embodiment) and selects one of the preset training programs (which may include time parameter, frequency parameter and posture parameter). Under manual operating mode, the user enters customized exercise parameters which may include amplitude parameter, frequency parameter, time parameter and posture parameter as desired.

Thereafter, the vibration trainer starts to work, and in the meantime the user may do exercise on the platform (20) and have his/her body like limbs, back or hip to lie or put on the platform (20). The user thus gets sports effect during the exercise with the vibration.

Besides, if the customized exercise parameters are out of a specific permissible range and may cause uncomfortable feelings during the exercise, the display unit (16) will give a warning signal visually to warn the user.

Figure 5:
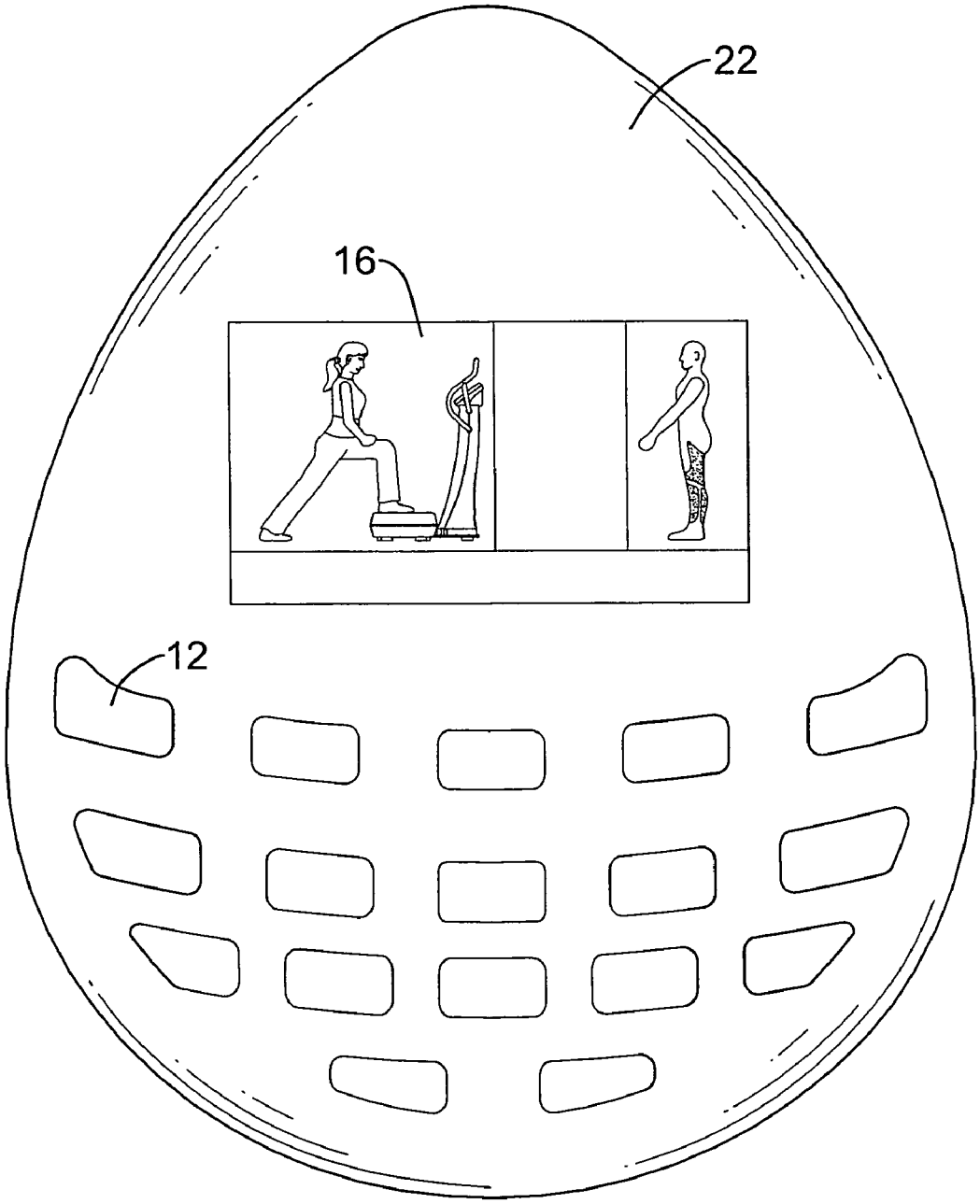
FIG. 5 is a vertical view of a control panel of the exercise machine in FIG. 4.

With further reference to FIG. 5, while the vibration trainer (2) is started, the display unit (16) will start to show a dynamic image or static image that demonstrates one exercising posture. The display unit (16) may further display another image that indicates what kind of muscle groups the user may train.

Figure 6:
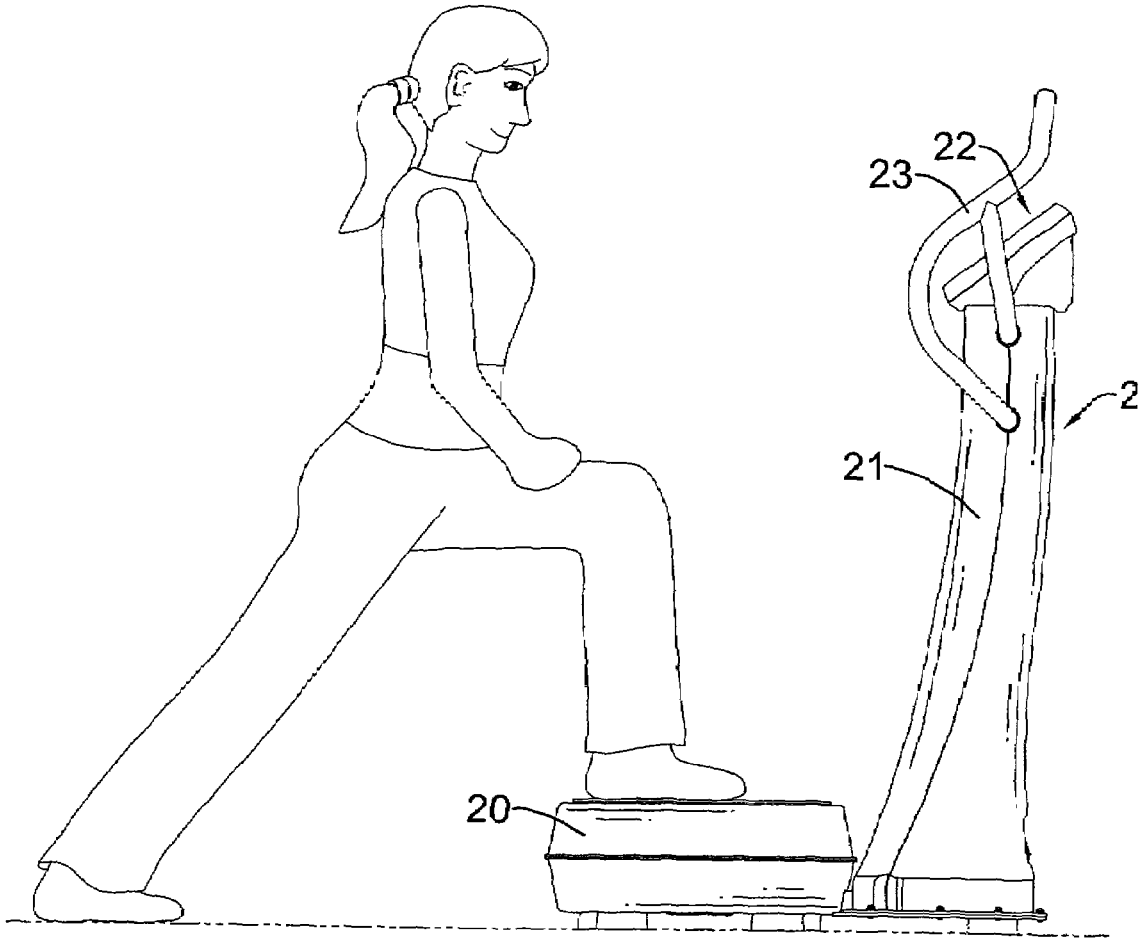
FIG. 6 is an operational front view of the exercise machine in FIG. 4.
Figure 7:
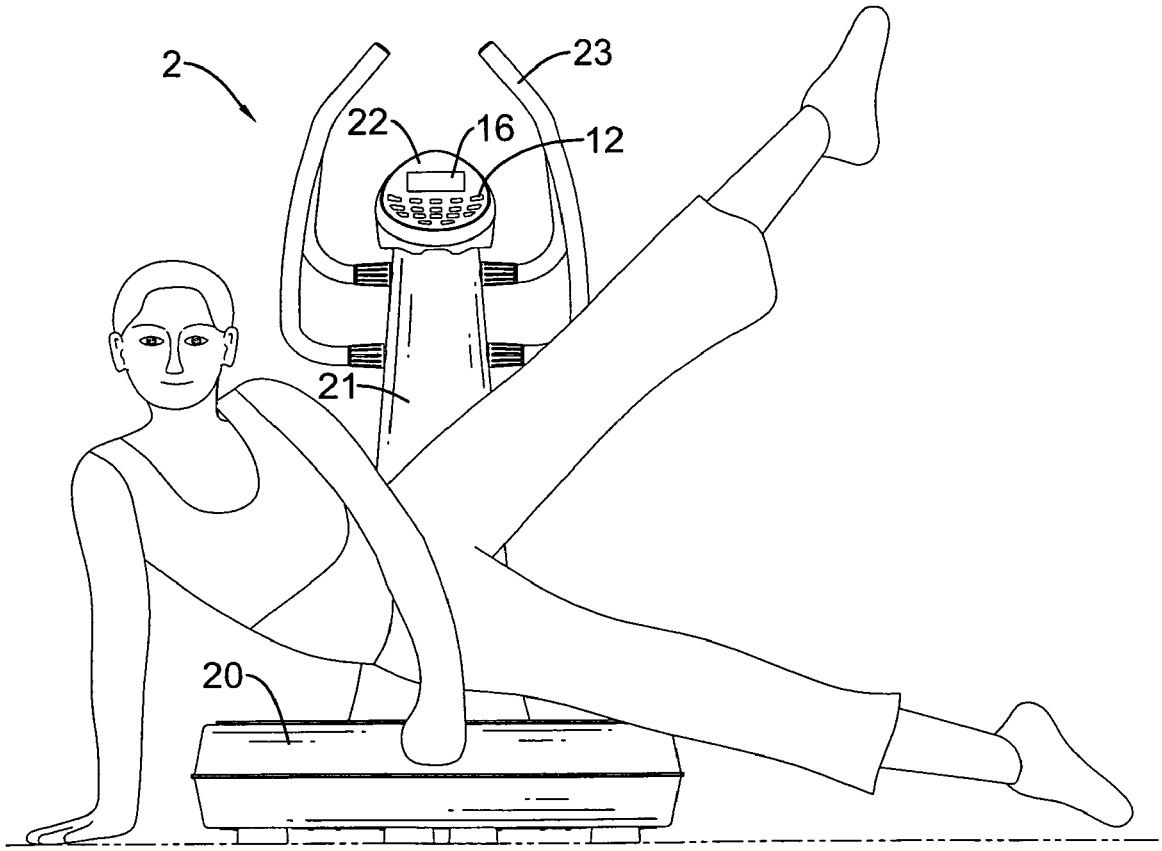
FIG. 7 is an operational side view of the exercise machine in FIG. 4.

With further reference to FIGS. 6 and 7, the user follows the foregoing image to do exercise on the vibration trainer (2). After a certain time, the display unit (16) shows a next image sequentially, and the user changes his/her movement to follow the next image until the operating time of the mode is end.

To provide a suitable training strength for the users according to their personal physical parameters and automatic operating mode, each preset training program corresponds to a specific permissible range of personal physical parameters. When a preset training program is selected and the corresponding permissible range does not meet the previously entered personal physical parameters, the exercise machine will only be operated with a suitable training strength to make sure that the user can bear the whole training strength. Hence, after the step of generating an automatic operating command (105), following steps may be executed:

determining whether the entered personal physical parameters are out of a permissible range corresponding to the selected training program; and providing certain suitable training strength by the exercise machine when the personal physical parameters are out of the permissible range.

Taking the vibration trainer as an example, the user selects the exercise level and then selects one of the preset training programs under the automatic operating mode. The exercise level relates to the value of amplitude of the vibration trainer (2) and the selected preset training program includes a time parameter, a frequency parameter and a posture parameter that respectively corresponds to a time, a frequency and a posture. If the time is 15 seconds, the frequency is 30 Hz and the posture is like the motions shown in FIG. 6, the vibration trainer (2) will show the posture on the display unit (16) and perform a 30 Hz vibration for 15 seconds.

The said 15 seconds and 30 Hz thus correspond to a specific permissible range of personal physical parameters such as 45~60 kilograms, 150~165 centimeters, 18~30 year-old and regardless of gender. If the entered personal physical parameters are out of the said permissible range, the vibration trainer (2) thus automatically adjust the operating time to 10 seconds or the vibration frequency to 25 Hz, or just reduce the vibration amplitude.

The advantage of the exercise machine and the control method thereof is that the exercise machine can adjust its training strength base on the entered personal physical parameters. Even different users take the same training program, the training strength of the exercise machine will be different according to the personal physical parameters the users have set. Therefore users with different physical conditions will individually have the better sports effect.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A control method of an exercise machine, the control method comprising:

setting current personal physical parameters in the exercise machine;

receiving a mode selection command;

determining whether the exercise machine is being operated in either an automatic operating mode or a manual operating mode;

when the exercise machine is determined to be operated in the automatic operating mode, the control method further comprises steps of:

entering the automatic operating mode;

receiving a program selection command and selecting one of multiple training programs being stored in the exercise machine;

generating an automatic operating command based on the current personal physical parameters and the selected training program; and outputting the automatic operating command to activate the exercise machine based on the automatic operating command, wherein after generating the automatic operating command and before outputting the automatic operating command, determining whether the current personal physical parameters are within a permissible range corresponding to the selected training program, and providing a suitable training strength by the exercise machine when the current personal physical parameters are not within the permissible range; and when the exercise machine is determined to be operated in the manual operating mode, the control method further comprises steps of:

entering the manual operating mode;

setting customized exercise parameters;

generating a manual operating command according to the customized exercise parameters; and outputting the manual operating command and activating the exercise machine according to the manual operating command.

2. The control method as claimed in claim 1, after generating a manual operating command, the control method further comprising:

generating a warning signal by determining whether the customized exercise parameters are within a permissible range corresponding to the current personal physical parameters.

3. The control method as claimed in claim 2, wherein the current personal physical parameters include a weight parameter, a height parameter, an age parameter and a gender parameter;

the customized exercise parameters further include an amplitude parameter, a time parameter, a frequency parameter and a posture parameter; and the selected training program provides a series of exercising postures and includes multiple parameter sets respectively corresponding to the exercising postures and each parameter set having a time parameter, a frequency parameter and a posture parameter.

4. The control method as claimed in claim 1, wherein the current personal physical parameters include a weight parameter, a height parameter, an age parameter and a gender parameter;

the customized exercise parameters further include an amplitude parameter, a time parameter, a frequency parameter and a posture parameter; and the selected training program provides a series of exercising postures and includes multiple parameter sets respectively corresponding to the exercising postures and each parameter set having a time parameter, a frequency parameter and a posture parameter.

5. An exercise machine comprising:

a memory unit stored with multiple training programs each of which providing a series of exercising postures;

a command input unit for setting current personal physical parameters, customized exercise parameters and receiving a mode selection command and a program selection command;

a control unit connecting to the command input unit and the memory unit and receiving the personal physical parameters, the customized exercise parameters, the mode selection command or the program selection command from the command input unit, giving a manual operating command or an automatic operating command; and activating the exercise machine based on the current personal physical parameters, the customized exercise parameters, the program selection command, and either the manual operating command or the automatic operating command; wherein the activating in the automatic operating command is initiated after determining whether the entered current personal physical parameters are within a permissible range corresponding to the selected training program and providing a suitable training strength by the exercise machine when the current personal physical parameters are not within the permissible range;

a motive power generating unit connecting to the control unit through a connecting interface, receiving the operating commands of the control unit and being driven according to the received operating commands; and a power supply unit connecting to the control unit and providing electric power to the control unit.

6. The exercise machine as claimed in claim 5, wherein the memory unit further stores with multiple posture display images respectively demonstrating the exercising postures and being shown by the exercise machine visually.

7. The exercise machine as claimed in claim 6, wherein the exercise machine further comprises a display unit connected to the control unit and displaying one of the posture display images of the memory unit to demonstrate how the exercising posture is practiced.

8. The exercise machine as claimed in claim 7, wherein the exercise machine is a vibration trainer.

9. The exercise machine as claimed in claim 8, wherein the vibration trainer further comprises:

a platform having a top surface and an edge, wherein the motive power generating unit is mounted inside the platform to bring vibrations to the top surface of the platform;

a neck upwardly extending from the edge of the platform and having a top and two sides;

a control panel mounted upon the top of the neck, wherein the command input unit and the display unit are both mounted on the control panel; and a handle set having two handles mounted and respectively extending from the sides of the neck.

10. The exercise machine as claimed in claim 5, wherein each training program further includes multiple parameter sets respectively corresponding to the exercising postures, and each parameter set has a time parameter defining an operating time of the exercise machine; and a frequency parameter defining an operating frequency of the exercise machine.

11. The exercise machine as claimed in claim 5, wherein the current personal physical parameters further include a weight parameter, a height parameter, an age parameter and a gender parameter; and the customized exercise parameters further include an amplitude parameter representing an operating amplitude of the exercise machine;

a time parameter representing an operating time of the exercise machine; and a frequency parameter representing an operating frequency of the exercise machine.

* * * * *